United States Patent [19]

Sperr et al.

[11] Patent Number: 4,576,013

[45] Date of Patent: Mar. 18, 1986

[54] EVAPORATIVE COOLING

[75] Inventors: Charles J. Sperr; Douglas C. Sperr, both of 8432 E. Wilshire Dr., Scottsdale, Ariz. 85257; Thad J. Genrich, Mesa, all of Ariz.

[73] Assignees: Charles J. Sperr; Douglas C. Sperr, both of Phoenix, Ariz.

[21] Appl. No.: 592,464

[22] Filed: Mar. 22, 1984

[51] Int. Cl.[4] ..... F28D 3/00

[52] U.S. Cl. ..... 62/171; 62/315; 261/26; 261/DIG. 46

[58] Field of Search ..... 62/171, 157, 231, 310, 62/305, 304, DIG. 16; 261/26, 27, DIG. 3, DIG. 43, DIG. 46, DIG. 34

[56] References Cited

U.S. PATENT DOCUMENTS

| | | | |
|---|---|---|---|
| 4,289,713 | 9/1981 | Goettl | 261/DIG. 46 |
| 4,353,219 | 10/1982 | Patrick, Jr. | 62/315 |
| 4,369,148 | 1/1983 | Hawkins | 261/DIG. 46 |
| 4,379,712 | 4/1983 | Sperr, Jr. et al. | 261/26 |

*Primary Examiner*—Harry Tanner

*Attorney, Agent, or Firm*—Don J. Flickinger

[57] ABSTRACT

An improved evaporative cooler contains a first pump for supplying cooling liquid to the evaporative pads and a second pump for draining liquid in the sump pan through a drain/overflow pipe. Both pumps are coupled to an electronic control mechanism which activates the first pump for a first predetermined period of time within each successive second predetermined period of time (e.g. the first 2.5 minutes of every successive 10 minute period). The control mechanism causes the second pump to drain the sump pan through the drain-/overflow pipe for a third predetermined period of time following the first occurence of the first predetermined period of time (e.g. for 5.0 minutes after the first 2.5 minute wetting cycle). This draining process occurs only once each time the evaporative cooler is turned on. The drain/overflow pipe has an upper end coupled to the outlet of the second pump and also has an aperture in the wall thereof through which excess liquid in the sump pump will flow and be discharged.

14 Claims, 5 Drawing Figures

FIG. 1
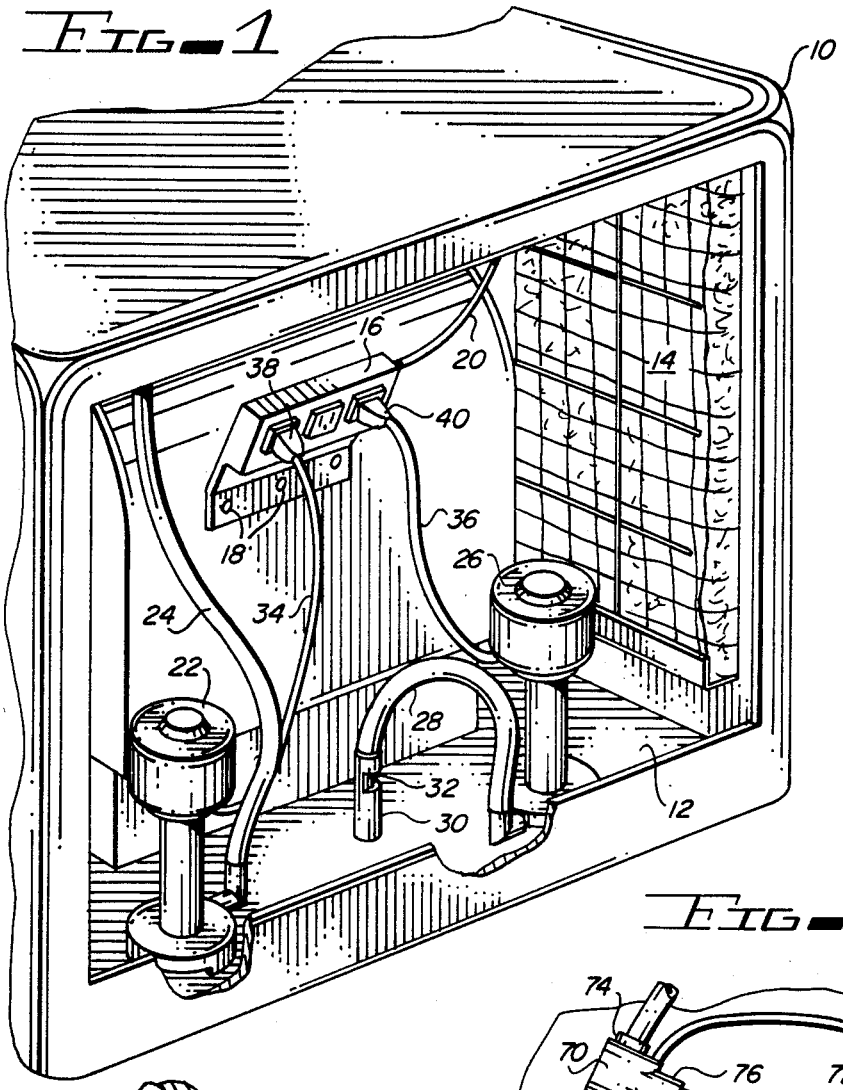
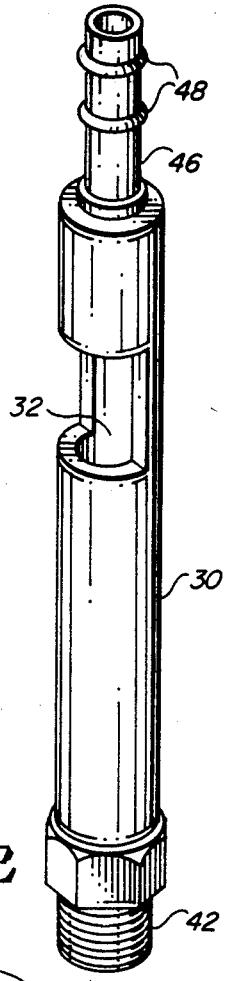
FIG. 2
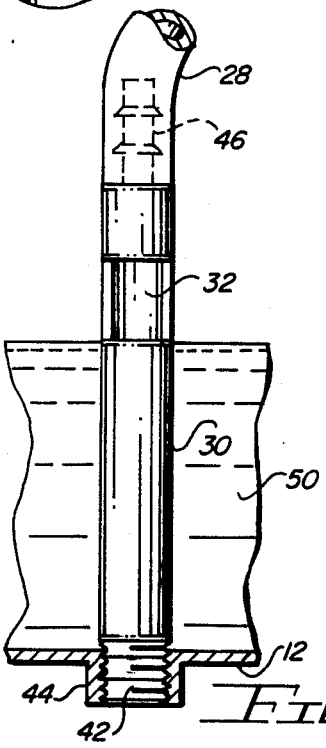
FIG. 3
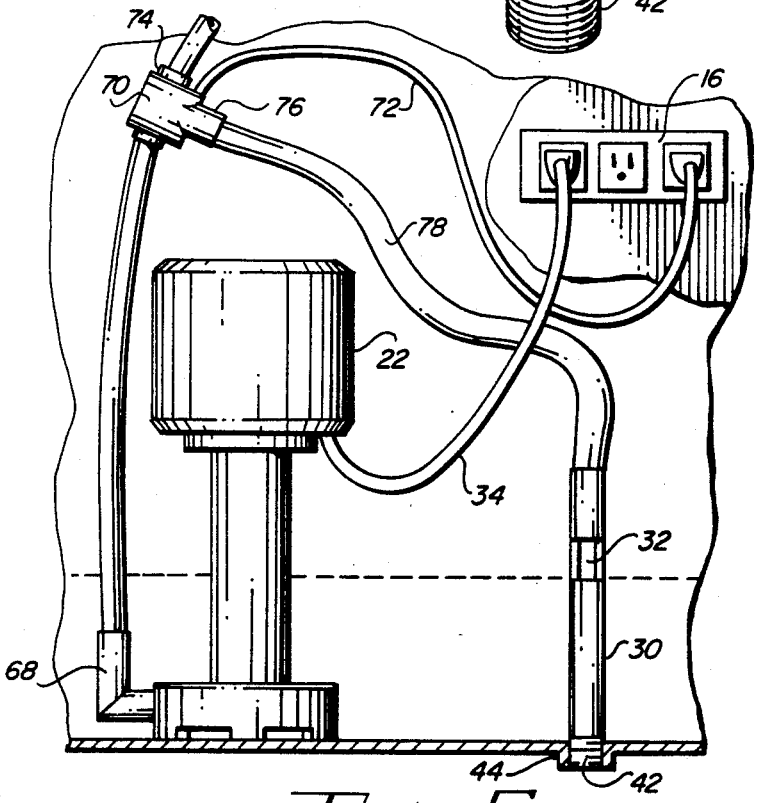
FIG. 5

EVAPORATIVE COOLING

BACKGROUND OF THE INVENTION

1. Field of the Invention

This invention relates generally to evaporative cooling devices having wettable air permeable pads and, more particularly, to an evaporative cooling system which provides for intermittent wetting of the cooling pads and drainage of the sump pan at selected intervals.

2. Prior Art

It is well known to employ evaporative coolers to produce and direct cool air into an enclosure such as a residence. Such coolers are extremely popular, especially in arid or semi-arid regions, due in part to the fact that they require substantially less energy than compressor operated refrigeration units. Furthermore, they provide for periodic air exchange within the enclosure and for the introduction of moisture into overly dry air. They are inexpensive to purchase and comparatively simple and economical to install and maintain.

Traditionally, evaporative coolers include a box like housing which serves as the main frame. Angular corners, extending between the top and the bottom, define upright open sides, and a pad assembly, typically including a louvered frame holding a water wettable, air permeable pad, spans the opening of each side. The pads are fabricated from a saturable material such as aspen fiber.

A bottom, having an upturned peripheral edge upon which the pad assemblies rest, functions as a reservoir or sump pan for retaining the coolant liquid, usually water. A pump transfers the liquid from the reservoir to a distribution system for delivery to the pads.

Located within the housing is a blower which draws a stream of air through each of the several pads and discharges the air through a common duct communicating with the enclosure to be cooled. As the air moves through the pads, water is evaporated to absorb a portion of the heat within the air. The moisture content of the air is also raised. A float senses the water level within the reservoir and controls an inlet valve to compensate for loses due to evaporation.

Testing has shown that all other things being equal, intermittent wetting of the cooler pads produces an overall exit temperature that is lower than that achieved by conventional pad wetting methods. Such an intermittent wetting technique is described in U.S. Pat. No. 4,379,712, entitled "Evaporative Cooler", issued Apr. 12, 1983.

A significant problem associated with conventional evaporative coolers is the requirement for relatively high routine maintenance. This is due to the fact that dirt, air born contaminants and calcium build ups are washed from the pads and collect in the sump pan of the cooler. Over a period of time, these contaminants accumulate on the interior surfaces of the cooler and are recirculated through the pads degrading performance and producing a non-hygenic environment.

SUMMARY OF THE INVENTION

It is an object of the present invention to provide an improved evaporative cooler.

It is a further object of the present invention to provide an evaporative cooler which provides for drainage of the sump pan at selected intervals.

It is yet another object of the present invention to provide an evaporative cooler wherein performance is not degraded as a result of the accumulation of contaminants in the pads.

A still further object of the present invention is to provide an overflow/drainage port which provides for both overflow drainage and sump drainage.

Yet another object of the present invention is to provide an improved evaporative cooler which includes means for extending pad life.

A still further object of the present invention is to provide an improved evaporative cooler wherein maintenance is reduced as a result of removal of calcium and other contaminants from the sump pan.

It is a still further object of the present invention to provide an improved evaporative cooler wherein the sump pan may be drained and refilled at selected intervals.

A further object of the present invention is to provide an improved evaporative cooler wherein the sump pan may be drained and then refilled with clean water at intervals selective the cooler functioning cycle.

Yet another object of the present invention is to provide an evaporative cooler including first and second pumps wherein the first pump delivers water to the pads intermittently during operation of the cooler and the second pump drains water from the sump pan each time the cooler is switched on.

According to a broad aspect of the invention there is provided an improved evaporative cooler of the type which includes a housing, at least one air pervious liquid absorbing evaporative pad spanning an opening in said housing through which a stream of air is drawn by a blower to cool the air, a sump pan at a lower portion of the housing for serving as a reservoir of cooling liquid and a float valve assembly coupled to a source of cooling liquid for supplying the sump pan with cooling liquid as needed. The improved evaporative cooler comprises a drain pipe, pump means for supplying liquid to the at least one evaporative pad and for draining liquid through the drain pipe, and control means for causing the pump means to supply liquid to the evaporative pad for a first predetermined period of time out of each successive second predetermined period of time and for causing the pump means to drain the liquid in said sump pan through the drain pipe for a third predetermined period of time following the first occurence of the first predetermined period of time after the cooler is turned on.

For example, for each ten minute period of time, the control means causes the pump means to supply liquid to the evaporative pad for the first 2.5 minutes. The pad is then allowed to dry for the next 7.5 minutes. When the cooler is initially turned on, the pump means drains the sump pan through the drain pipe after the initial wetting period and for a period of 5.0 minutes thereafter. The float valve assembly will then cause the sump pan to be filled with clean water. The drain pipe consists of a hollow cylindrical pipe coupled vertically within the cooler housing and having a discharge end leading to the exterior of the housing. The upper portion of the pipe is coupled to the pump means for receiving liquid to be discharged. In addition, an aperture is cut into the side of the drain pipe proximate its upper end to serve as an overflow discharge should the level of liquid in the sump pan rise to and beyond the level of the aperture.

In accordance with an embodiment of the invention, the pump means includes a first pump for supplying liquid to the pad and a second pump for draining the sump pan. In accordance with an alternate embodiment, the pump means comprises a single pump and a poleroid operated valve for selectively directing liquid to either the pad or the drain pipe. Further, the sump pan may be drained at selected intervals by manually operatable control means.

The above and other objects, features and advantages of the present invention will be more clearly understood from the following detailed description taken in conjunction with the accompanying drawings, in which:

BRIEF DESCRIPTION OF THE DRAWINGS

FIG. 1 is a perspective view of the interior portion of an improved evaporative cooler according the present invention;

FIG. 2 is a perspective view of the drain pipe used in conjunction with the evaporative cooler shown in FIG. 1;

FIG. 3 illustrates in more detail how the drain pipe is secured within the sump pan of the evaporative cooler shown in FIG. 1;

FIG. 5 illustrates an alternate embodiment of the improved evaporative cooler according to the present invention.

DESCRIPTION OF THE PREFERRED EMBODIMENT

Figure 4:
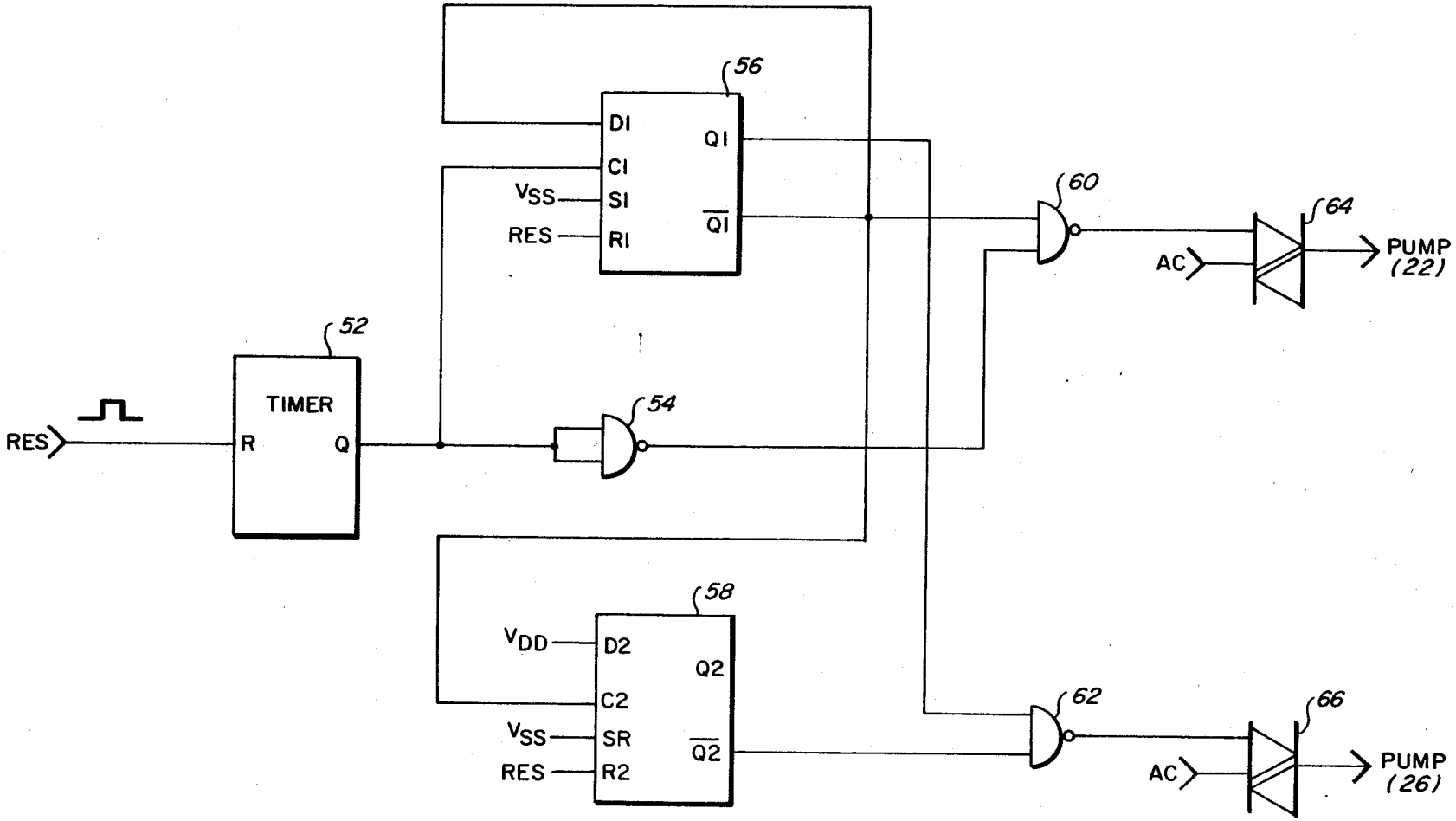
FIG. 4 is a schematic diagram of the control mechanism used in conjunction with the improved evaporative cooler.

Referring to FIG. 1, there is shown an evaporative cooler of the type which includes a housing 10, a sump pan 12, at least one air pervious evaporative pad 14 through which air is drawn by a blower (not shown) so as to cool the air prior to it being supplied to an enclosure. The evaporative cooler chosen for purposes of illustration is intended typically representative of commercially available devices of the immediate type. It will be appreciated that details not specifically shown nor described will be readily apparent and understood by those skilled in the art.

An electronic control mechanism 16 (to be described in greater detail hereinbelow) is secured to the inner portion of housing 10 as for example by screws 18. Control mechanism 16 receives its power via line 20 from any existing power source. A first pump 22 is positioned within housing 10 so as to pump cooling liquid within sump pan 12 via hose 24 to a cooling liquid distribution system of the type well known to those skilled in the art. This is performed for a first predetermined period of time (e.g. 2.5 minutes) out of each successive predetermined period of time (e.g. 10 minutes). Thus, water is supplied to pad 14 by pump means 22 for the first 2.5 minutes out of each 10 minute period under the control of control system 16.

A second pump 26 is mounted in sump pan 12 so as to drain sump pan 12 via hose 28 and a drain/overflow pipe 30. As can be seen, hose 28 is coupled to an upper portion of drain pipe 30 which is in turn secured to the bottom portion of sump pan 12. Drain/overflow pipe 30 is provided with an aperture 32 for receiving excess liquid in sump pan 12 and permitting it to drain to the exterior of housing 10. Control mechanism 16 controls pump 26 in such a manner as to cause it to drain the sump pan after the first pad wetting period each time power is supplied to the evaporative cooler.

Pumps 22 and 26 are coupled to control mechanism 16 by lines 34 and 36, respectively, which supply power to and control the operation of pumps 22 and 26. As can be seen, lines 34 and 36 are terminated with plugs 38 and 40 respectively which are received by receptacles in the control mechanism 16. An optional third receptacle carried by control mechanism 16 provides a ready source of line current to operate either pump or to operate power tools as required by maintence personnel.

FIG. 2 illustrates in more detail the drain/overflow pipe 30 described in connection with FIG. 1. As can be seen, drain pipe 30 includes an externally threaded portion 42 which is received by an internally threaded socket 44 (FIG. 3) in the bottom of sump pan 12. Pipe 30 includes an upper extension 46 of smaller diameter and including ridges 48 over which the end of hose 28 is received and secured as is shown in FIG. 3. Thus, when the cooling liquid in sump pan 12 is drained by pump 26, the liquid flows through pipe 28 into the upper portion 46 of drain/overflow pipe 30. The liquid will then fall through the pipe and exit out the discharge end 42.

FIG. 4 is a logic diagram of the circuit contained in control mechanism 16. The circuit is activated by logical high signals (Vdd) and logical low signals (Vss). In addition, a reset pulse (RES) is generated using any one of a variety of known techniques each time power to the evaporative cooler is initially turned on.

As can be seen, the circuit includes a timer 52 such as an MC 14541, available from Motorola Inc., which generates a square wave having a period of five minutes. The output of timer 52 is coupled to first and second inputs of NAND gate 54 and to the clock input of flip-flop 56. The set input (S1) of flip-flop 56 is coupled to Vss, and the reset input (R1) is coupled to the reset signal RES. The $\overline{Q1}$ output of flip-flop 56 is coupled to the D1 input of flip-flop 56 and to the clock input (C2) of flip-flop 58. The D2 input of flip-flop 58 is coupled to Vdd, the set input (S2) is coupled to Vss and the reset input (R2) is coupled to the reset signal (RES). Each of flip-flops 56 and 58 may be of the type available from Motorola Inc. and bearing part number MC 14013. NAND gate 60 has a first input coupled to the $\overline{Q1}$ output of flip-flop 56 and a second input coupled to the output of NAND gate 54. NAND gate 62 has a first input coupled to the $\overline{Q1}$ output of flip-flop 56 and a second input coupled to the $\overline{Q2}$ output of flip-flop 58.

The output of NAND gate 60 triggers triac 64 so as to cause AC power to be applied to pump 22. Similarly, the output of NAND gate 62 triggers triac 66 so as to pass AC power to drain pump 26.

The circuit operates as follows. When power is first applied to the cooler, a reset signal is generated which causes timer 52 and flip-flops 56 and 58 to reset. In this case, logical highs are applied to both inputs of NAND gate 60 causing a logical low to appear at its output. Since a logical low triggers triac 64, pump 22 will be energized. In contrast, since flip-flop 56 is reset, a logical low is applied to the first input of NAND gate 62 causing a high to appear at its output. Triac 66 remains closed and drain pump 26 is not energized. After 2.5 minutes has elapsed, the output Q of timer 52 changes from a logical "0" or low to a logical "1" or high state. Since flip-flops 56 and 58 will trigger on the leading edge of a signal applied to their clock input, and since a logical high as being applied to the D1 input of flip-flop 56, flip-flop 56 will change states when the output of timer 52 changes from a logical "0" to a logical "1". In this case, $\overline{Q1}$ goes low causing a logical 1 to appear at the output of NAND gate 60 thus interrupting power to wetting pump 22. In contrast, since flip-flop 58 did not change state and Q1 changed from a logical low to a logical high state, logical high signals are supplied to both inputs of NAND gate 62 causing triac 66 to be triggered and allowing AC power to be supplied to drain pump 26.

Two and one half minutes later when the Q output of timer 52 goes from a logical high to a logical low, neither flip-flop will change states since flip-flop 56 does not trigger on the falling edge of the clock signal. However, when the Q output of timer 56 again goes high, flip-flop 56 will change state causing flip-flop 58 to also change state. Q2 will go high and Q2 will go low causing high to appear at the output of NAND gate 26, thus disabling triac 66. It should be noted that flip-flop 56 cannot be reset again until the unit is shut down and power reapplied to generate a reset signal (RES). Thus, pump 26 is only activated once after the initial wetting period each time power is applied to the evaporative cooler.

With the output of timer 52 now high, a low appears at the output of NAND gate 54 thus causing the output of NAND gate 60 to be high disabling triac 64. Thus, for the next 2.5 minutes, the wetting pump 22 will be disabled. When the output of timer Q goes low again, the wetting cycle is repeated. Thus, for the first 2.5 minutes out of every successive 10 minute period, the wetting pump 22 will be activated.

FIG. 5 illustrates an alternate embodiment of the present invention wherein only a single pump 22 is utilized to pump liquid to the evaporative pads and also to pump liquid to drain pipe 30. As can be seen, the outlet 60 of pump 22 is coupled to the input of a two position solenoid operated valve 70 which is controlled via line 72 by control mechanism 16. Valve 70 has a first output 74 which leads to the liquid distribution system for wetting the pads and a second output 76 which is coupled by means of hose 78 to the upper portion of drain/overflow pipe 30 as previously described. In this case, only a single pumping mechanism is utilized. Valve 70 is controlled by control mechanism 16 such that for the first 2.5 minutes out of each successive 10 minute cycle valve 70 is in position to permit liquid to flow through outlet 74. Furthermore, control mechanism 16 causes valve 70 to switch, via line 72, and permits liquid to flow through outlet 76 following initial wetting period after power is applied to the cooler.

Not only is the efficiency of the improved evaporative cooler improved by intermittent wetting, but also the need for routine maintenance is substantially reduced since the sump pan along with the calcium and other contaminants is drained every time the cooler is turned on.

Various changes and modifications to the embodiments herein chosen for purposes of illustration will readily occur to those skilled in the art. For example, overflow/drain pipe 30 has been illustrated as being cylindrical and threadedly coupled with the typical drain aperture of a conventional evaporative cooler. As will be appreciated, the pipe may be variously configured to accomodate hose 28 and overflow opening 32. Also, the pipe may be secured by conventional means to a special opening formed in either the bottom or the sidewall of sump pan 12. Further, while pump 22 and 26 in FIG. 1 and pump 22 and valve 70 in FIG. 5 have been shown and described as being controlled by an electronic control circuit, these elements could more simply be controlled manually as by the manual opening and closing of switches.

To the extent that such modifications and variations do not depart from the spirit of the invention, they are intended to be included within the scope thereof which is limited only by a fair assessment of the following claims.

Having fully described the present invention and alternately preferred embodiments thereof in such clear and concise terms as to enable those skilled in the art to understand and practice the same, The invention claimed is:

1. An improved evaporative cooler of the type which includes a housing, at least one air pervious liquid absorbing pad spanning an opening in said housing through which a stream of air is drawn to cool the air, and a sump pan at a lower portion of said housing for serving as a reservoir of cooling liquid, said improved evaporative cooler comprising:

a drain pipe;

pump means for supplying liquid to said at least one evaporative pad and for draining liquid through said drain pipe; and control means coupled to said pump means for causing said pump means to supply liquid to said at least one evaporative pad for a first predetermined period of time out of each successive second predetermined period of time and for causing said pump means to drain said liquid through said drain pipe for a third predetermined period of time following the first occurence of said first predetermined period of time after said evaporative cooler is turned on.

2. Evaporative cooler according to claim 1 wherein said pump means comprises;

a first pump positioned in said sump pan and responsive to said control means for supplying liquid to said at least one pad; and a second pump positioned in said sump pan and responsive to said control means for draining said sump pan.

3. An evaporative cooler according to claim 2 wherein said drain pipe includes an inlet end coupled to said second pump, an outlet end removably attached to said sump pan for conducting liquid therethrough, and an aperture in the wall of said drain pipe for receiving excess liquid in said sump pan and conducting it through said outlet.

4. An evaporative cooler according to claim 3 wherein a lower portion of said drain pipe threadably engages an opening in said sump pan.

5. An evaporative cooler according to claim 3 wherein said control means includes timer means for measuring said first, second and third predetermined periods of time.

6. An evaporative cooler according to claim 4 wherein said first predetermined period of time is substantially 2.5 minutes in length and said second predetermined period of time is substantially 10 minutes in length.

7. An evaporative cooler according to claim 6 wherein said third predetermined period of time is approximately 5.0 minutes in length.

8. An evaporative cooler according to claim 1 wherein said pump means comprises:

a first pump positioned in said sump pump and having an inlet and an outlet; and a two-position valve responsive to said control means and having an input coupled to said outlet, having a first output for supplying liquid to said at least one pad and having a second output for supplying liquid to said drain pipe.

9. A drain apparatus for use in conjunction with an evaporative cooler having a sump pan for holding cooling liquid, and an evaporative pad, said drain apparatus comprising:

a. a pump including
   i. an inlet communicating with said cooling liquid, and
   ii. an outlet;
b. a drain pipe including
   i. an inlet end
   ii. an outlet end for conducting said cooling liquid through said sump pan; and
   iii. an aperture in a wall of said drain pipe for receiving excess liquid accumulated in said sump pan and conducting said excess liquid through the outlet end;
c. conduit means communicating between the outlet of said pump and the inlet of said drain pipe

10. The drain apparatus of claim 9, wherein outlet end of said drain pipe projects through an opening in said sump pan.

11. The drain apparatus of claim 10 wherein the outlet end of said drain pipe is threadedly engaged within the opening in said sump pan.

12. The drain apparatus of claim 9, wherein said conduit means includes:

a. a reduced diameter extension projecting from the inlet end of said drain pipe; and
b. a hose extending from the outlet of said pump and coupled with the extension projecting form said drain pipe.

13. The drain apparatus of claim 9, wherein said evaporative cooler further includes a conduit for conveying said cooling liquid to said pad and said conduit means further includes a valve for receiving cooling liquid from said pump and selectively directing said cooling liquid to said drain pipe or said conduit.

14. A method of supplying cooling liquid to at least one air pervious liquid absorbing pad spanning an opening in a housing of an evaporative cooler wherein the cooling liquid is stored in a sump pan at a lower portion of said housing, the method comprising:

intermittently supplying liquid to said at least one evaporative pad for a first predetermined period of time out of each successive second predetermined period of time; and periodically draining liquid from said sump pan for a third predetermined period of time following the first occurrence of said first predetermined period of time after said cooler is turned on.

* * * * *